United States Patent [19]

Olsin

[11] 4,060,943

[45] Dec. 6, 1977

[54] METAL WORKING COMPOUND

[76] Inventor: Albert Olsin, 4129 Princeton Blvd., South Euclid, Ohio 44121

[21] Appl. No.: 669,686

[22] Filed: Mar. 23, 1976

[51] Int. Cl.[2] ..... B24B 1/00

[52] U.S. Cl. ..... 51/281 R; 51/304

[58] Field of Search ..... 51/281 R, 304, 305

[56] References Cited

U.S. PATENT DOCUMENTS

| | | | |
|---|---|---|---|
| 2,642,348 | 6/1953 | Stier | 51/304 X |
| 2,681,274 | 6/1954 | Young | 51/305 |
| 2,829,035 | 4/1958 | Doughty | 51/304 |
| 2,885,838 | 5/1959 | Waite | 51/281 R X |
| 2,904,419 | 9/1959 | Couch | 51/305 |
| 2,980,524 | 4/1961 | Morton | 51/304 X |
| 3,990,192 | 11/1976 | Bonnice | 51/325 |

*Primary Examiner*—Gary L. Smith
*Attorney, Agent, or Firm*—Wesley B. Taylor

[57] ABSTRACT

A metal working compound is disclosed, especially for non-ferrous metals, adapted to be applied to the metal or to an instrument for working the metal. The compound comprises a solid fat glyceride and predominantly a triglyceride having a range of properties which uniquely adapt the compound for functioning not only as a lubricant but one which, because of its properties, remains substantially at the work area of contact between the metal and instrument and is not lost due to splattering, centrifugal action, and the like.

6 Claims, No Drawings

METAL WORKING COMPOUND

BACKGROUND OF THE INVENTION

In the working or shaping of a metal by an instrument, such as a grinding wheel, belt sander, and the like, it is necessary to lubricate the operation. However, ordinary lubricants only temporarily ease frictional contact between the metal and instrument and are but briefly effective. Even worse, as metal particles become coated with oil and the like, they tend to form sticky clusters of particles which foul the operation by clogging pores of a grinding wheel, for example. This results in a shortened useful life for the instrument which has to be redressed more often than would otherwise be the case. Not only liquid lubricating oils but normally solid lubricants of low melting points have this shortcoming.

The problem is increased when one of the metal or working instruments is rotated, for instance, when the metal is mounted in a lathe or when the working instrument is a rotating drill. Then ordinary lubricants splatter or run or are thrown off by centrifugal action. Often, it becomes necessary to apply continuously a running stream of oil, for example, in order to achieve a desired lubricating action.

The problem is especially augmented in the case of non-ferrous metals, such as aluminum or copper. Because principally of their lower melting points, non-ferrous metals exhibit a self-welding effect. Under heat generated by an instrument, non-ferrous metals tend to flow and weld themselves to the instrument, thereby completely fouling the instrument and the working operation.

SUMMARY OF THE INVENTION

It has now been found that these problems are substantially lessened or overcome, especially for a non-ferrous metal, by a metal working compound comprising a glyceride and preferably comprising in predominant amount a triglyceride in which all of the glycerides have alkyl or alkenyl moieties of from about 7 to about 17 carbon atoms, the working compound having a melting point within the range of about 100° to about 125° F, a softening point within about 10° F of the melting point, an iodine value number no greater than about 10, and a solid fat index at 80° F within the range of about 35% to about 60%.

In use, the working compound of the present invention, which is solid at room temperatures, is merely applied to the metal or the working instrument or to both. The compound has a sufficiently low melting point that under the heat generated by contact between the metal and instrument, the compound is readily reduced from a solid state to a flowable, lubricating liquid. But as soon as the compound leaves the immediate area of contact or heat is otherwise removed, the compound immediately sufficiently congeals that is does not splatter or otherwise fly off due to centrifugal force because of its closely associated softening point on the temperature scale.

Further, in solid or liquid form, the working compound alone fills the pores of the working instrument and prevents the build-up in the pores of metal particles created by the operation. Also, the present compound does not have the adhesiveness of normal lubricants, such that there is little or no build-up of clusters of particles otherwise held together by a sticky lubricant and which can foul a metal-shaping operation. Still further, the present metal working compound successfully counteracts the welding action of non-ferrous metals to a forming instrument.

DESCRIPTION OF THE PREFERRED EMBODIMENTS

Although, as indicated, the present working compound is useful for all metals and alloys, it is especially effective in working with non-ferrous metals. Non-ferrous metals are well known in the art and include, for example, aluminum, copper, zinc, berylium, many alloys such as brass, bronze, alloys rich in nickel and chronium such as the stainless steels, and the like. As used here and in the claims, the term "instrument" for working the metal means any tool or implement which frictionally contacts the metal for any metal forming operation. Such an instrument may include, without limitation, such means as drills, saws, sanders such as a belt sander, grinding wheels, machining tools, bits, and the like.

The present metal working compound comprises oil soluble, hyrophobic, oxidatively stable, glyceride-based solid fats which have certain ranges of physical properties that uniquely adapt them for the purpose described. The present compounds contain a major and predominant amount of a triglyceride although, optionally, the compound may contain from 0% to about 5% by weight of a monoglyceride and from 0% to about 5% by weight of a diglyceride. Although neither need be present, at times the presence of a monoglyceride or a diglyceride has an advantage. For example, such glycerides can facilitate mold release of the metal working compound by eliminating or reducing an inherently poor contractibility of triglycerides. All of the glycerides can be synthetically prepared in a manner known in the art from suitable oils, such as cocoa nut and palm kernel oils. In all cases, all of the glycerides have alkyl or alkenyl moieties of from about 7 to about 17 carbon atoms. Lauric acid with 11 carbon atoms can be a major fatty acid component, although the glycerides are usually mixed esters. Where carbon to carbon unsaturation is present, it may be due to fatty acid moieties derived from fatty acids like ricinolic acid. In the case of the triglyceride, the formula may be represented as:

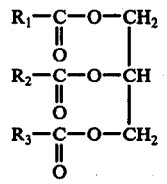

in which $R_1$, $R_2$, and $R_3$ can be the same or different and represent the alkyl or alkenyl radicals of from about 7 to about 17 carbon atoms.

The physical properties of the present metal working compounds can be modified by controlling the percentage of a particular fatty acid fraction in the molecule. Accordingly, a present compound containing a high percentage of lauric acid has properties differing from one containing a high percentage of stearic acid. However, the metal working compound must have a melting point within the range of about 100° to about 125° F and preferably within the range of about 115° to 125° F, a softening point within about 10° F of the melting point and preferably within 5° F, an iodine value number no greater than about 10 and preferably no greater than about 5, and a solid fat index at 80° F within the range of about 35% to about 60% and preferably in the range of about 35% to about 50%.

A melting point within the indicated broad range enables the metal working compound to retain a desired solid form for easy handling at room temperature and yet be quickly converted to a liquid, lubricating form under the action of heat generated by an instrument frictionally contacting the metal. A melting point below about 100° F renders the compound too soupy and the metal can be scratched by the instrument, while a melting point above about 125° F renders the compound waxy and tends to delay the desired conversion to a liquid lubricating form. A melting point within the indicated broad range also assures good thermal stability, that is, the compound does not bleed when it is not in use such as in storage or on a shelf.

It is essential that the present compound has a softening point within at least about 10° F of its melting point, that is, that there is a relatively narrow gap between the melting and softening points. It is this property especially which enables the compound to solidify quickly when a heat source is removed and minimizes if not eliminates the splattering and resultant loss of ordinary lubricants. The relatively quick conversion of liquid to solid form, and vice versa, also prevents clogging of the work instrument by clusters of metal particles which are held together in aggregated form when a liquid lubricant retains its adhesive character and liquid form even after cooling. The present compound also provides a smooth finish on the metal and tends to remain with the working edge of the instrument and lubricate the operation.

While the present metal working compound is preferably chemically saturated, some unsaturation can be tolerated up to an iodine value no greater than about 10 and preferably no greater than about 5. Chemical saturation or near chemical saturation eliminates the need for refrigeration. Solid glyceride fats meeting the requirements of the present invention have been found to have a solid fat index at 80° F within the range of about 35% to about 60% and preferably within the range of about 35% to about 50%. The numerical value of the Solid Fat Index is a function of temperature and the material being tested. It is an empirical measure in percent of the solid fat content of an oil-fat mixture at a stated temperature.

An example of a solid triglyceride capable of meeting the requirements of the present invention is what is known in the art as hard cocoa butter.

In view of its thermoplastic character and uniformity of composition, the present metal working compound can be readily molded by standard techniques in any desired shape or form such as a cylindrical stick. In use, one end of the stick or other form is merely applied with slight pressure against the working instrument, metal, or against both. It is understood that other ingredients in minor amounts may be added to the compound, such as lecithin, without detracting from the previously described advantages and properties of the compound.

The physical property values needed by the present metal working compound for the purposes indicated can be determined by tests known in the art. The suitability of a glyceride-based solid fat can, therefore, be ascertained by a series of screening tests or by trial and error techniques. Where analyses show that values of a test product lie outside of one or more of the range of properties previously disclosed, such as fatty acid component, solid fat index, iodine value manner, and the like, adjustments in composition and properties can be made to produce a formulation capable of acheiving the desired results, for example, by changing the amount or kind of alkyl or alkenyl substituents of the glyceride.

The following examples of the metal working compound are intended only to illustrate the invention and should not be construed to impose limitations on the claims.

EXAMPLE 1

A metal working compound of the present invention consisting essentially of a triglyceride of lauric acid had these properties:

| | |
|---|---|
| Wiley melting point | 112–114° F |
| Free fatty acids | 0.1% by weight, maximum |
| Iodine value No. | 4 |
| Solid Fat Index at 80° F | 47 |

EXAMPLE 2

Another metal working compound of essentially the same composition as that of Example 1 had a Wiley melting point of 101°–103° F and a Solid Fat Index at 80° F of 38.

EXAMPLE 3

Another metal working compound of essentially the same composition as that of Example 1 had a Wiley melting point of 117°–119° F and a Solid Fat Index at 80° F of 52.

Although the foregoing describes several embodiments of the present invention, it is understood that the invention may be practiced in still other forms within the scope of the following claims.

I claim:

1. In a process for working a metal by contacting the metal with a working instrument and forming particles of the metal, the improvement comprising applying to at least one of said metal and instrument prior to contacting the metal with a working instrument an abrasive-free working compound consisting essentially of from 0 to about 5% by weight of a monoglyceride, from 0 to about 5% by weight of a diglyceride, and the balance substantially a triglyceride, all of said glycerides having alkyl or alkenyl moieties of from about 7 to about 17 carbon atoms, said compound being solid at room temperatures and having a melting point within the range of about 100° to about 125° F, a softening point within about 10° F of the melting point, an iodine value number no greater than about 10, and a solid fat index at 80° F within the range of about 35% to about 60%, lubricating said working of the metal by said compound which, by virtue of said properties, remains substantially at or adjacent the work area of said contact with the metal, and preventing appreciable accumulation of said metal particles on said instrument by said working compound.

2. The process of claim 1 in which said metal working compound consists essentially of a triglyceride corresponding to the formula:

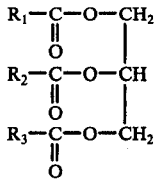

in which $R_1$, $R_2$, and $R_3$ can be the same or different and represent said alkyl or alkenyl radicals of from about 7 to about 17 carbon atoms.

3. The process of claim 1 in which said melting point is within the range of about 115° to about 120° F.

4. The process of claim 1 in which said softening point is within about 5° F of the melting point.

5. The process of claim 1 in which said compound is hard cocoa butter.

6. The process of claim 1 in which said metal is a non-ferrous metal.

* * * * *